US011874078B2

(12) United States Patent
Roe et al.

(10) Patent No.: US 11,874,078 B2
(45) Date of Patent: Jan. 16, 2024

(54) FIREARM MUZZLE ACCESSORY

(71) Applicant: Shadow Systems LLC, Plano, TX (US)

(72) Inventors: Richard Trevor Simpson Roe, Plano, TX (US); Benjamin Ni Ye, North Richland Hills, TX (US)

(73) Assignee: Shadow Systems LLC, Plano, TX (US)

( * ) Notice: Subject to any disclaimer, the term of this patent is extended or adjusted under 35 U.S.C. 154(b) by 43 days.

(21) Appl. No.: 17/680,067

(22) Filed: Feb. 24, 2022

(65) Prior Publication Data

US 2023/0228515 A1 Jul. 20, 2023

Related U.S. Application Data

(60) Provisional application No. 63/300,001, filed on Jan. 16, 2022.

(51) Int. Cl.

| | |
|---|---|
| ***F41A 21/32*** | (2006.01) |
| ***F41G 1/02*** | (2006.01) |
| *F41A 21/30* | (2006.01) |
| *F41A 21/34* | (2006.01) |
| *F41A 21/36* | (2006.01) |

(52) U.S. Cl.

CPC ..... *F41A 21/325* (2013.01); *F41G 1/02* (2013.01); *F41A 21/30* (2013.01); *F41A 21/34* (2013.01); *F41A 21/36* (2013.01)

(58) Field of Classification Search

CPC ..... F41G 1/02; F41A 21/30–42

USPC ..... 89/14.05, 14.2–14.4; 181/223

See application file for complete search history.

(56) References Cited

U.S. PATENT DOCUMENTS

| | | | | |
|---|---|---|---|---|
| 3,978,762 | A * | 9/1976 | Khaidurov | F41A 21/325 89/14.3 |
| 4,501,189 | A * | 2/1985 | Brandl | F41A 21/30 89/14.4 |
| 4,691,614 | A * | 9/1987 | Leffel | F41A 21/36 89/14.3 |
| 4,893,426 | A | 1/1990 | Bixler | |
| 5,479,737 | A * | 1/1996 | Osborne | F41A 21/12 89/14.05 |
| 5,559,302 | A | 9/1996 | Latka | |
| 5,794,374 | A * | 8/1998 | Crandall | F41C 27/22 42/76.01 |
| 6,450,079 | B1 * | 9/2002 | Bourdin | F41A 21/36 89/14.3 |

(Continued)

FOREIGN PATENT DOCUMENTS

| | | | |
|---|---|---|---|
| DE | 102005026975 | 12/2006 | |
| DE | 102014119738 A1 * | 6/2016 | F41A 21/30 |
| WO | 2023137242 | 7/2023 | |

OTHER PUBLICATIONS

Roe, Richard Trevor Simpson; International Search Report and Written Opinion for Application No. PCT/US2023/060188 filed Jan. 6, 2023, dated May 30, 2023, 15 pages.

(Continued)

*Primary Examiner* — Joshua E Freeman
*Assistant Examiner* — Benjamin S Gomberg
(74) *Attorney, Agent, or Firm* — Taylor English Duma LLP

(57) ABSTRACT

A muzzle accessory for installation on a barrel of a firearm is provided. The muzzle accessory includes an accessory body having a through-channel sized to receive the barrel of the firearm; and a locking member structured to engage the groove of the barrel to lock the muzzle accessory to the barrel.

30 Claims, 16 Drawing Sheets

(56) References Cited

U.S. PATENT DOCUMENTS

| | | | | |
|---|---|---|---|---|
| 9,182,187 | B1 | 11/2015 | Griffith | |
| 9,810,506 | B2 * | 11/2017 | Curry | F41C 3/14 |
| 9,970,727 | B2 * | 5/2018 | Niswander | F41A 21/34 |
| 10,767,952 | B1 * | 9/2020 | Till | F41A 21/325 |
| 11,112,201 | B2 * | 9/2021 | Warburton | F41C 3/14 |
| 2007/0095198 | A1 | 5/2007 | Dater et al. | |
| 2010/0154278 | A1 * | 6/2010 | Curry | F41A 21/36 42/107 |
| 2015/0135575 | A1 * | 5/2015 | Wood, Jr. | F41A 21/325 42/90 |
| 2020/0025498 | A1 * | 1/2020 | Wheeler | F41A 21/325 |
| 2023/0228515 | A1 * | 7/2023 | Roe | F41G 1/02 89/14.05 |

OTHER PUBLICATIONS

Roe, Richard Trevor Simpson; Invitation to Pay Additional Fees and, Where Applicable, Protest Fee for Application No. PCT/US2023/060188 filed Jan. 6, 2023, dated Apr. 6, 2023, 12 pages.

* cited by examiner

FIREARM MUZZLE ACCESSORY

RELATED APPLICATIONS

The present application claims the benefit of U.S. Provisional Patent Application No. 63/300,001 filed on Jan. 16, 2022 and entitled "MUZZLE ACCESSORY," the entire contents of which are expressly incorporated herein by reference.

BACKGROUND OF THE INVENTION

It is common to attach different types of muzzle accessories to the barrel of a firearm, such as, for example, a handgun. One such muzzle accessory is a compensator (or muzzle brake). Compensators typically operate by redirecting a portion of discharge gasses upwardly from the muzzle of a firearm, thereby reducing (or compensating for) unwanted upward motion of the firearm caused by recoil forces. A flash suppressor is another type of muzzle accessory that reduces the visible signature of a firearm by cooling or dispersing hot discharge gases that exit the muzzle. A silencing muzzle accessory (also known as a silencer or suppressor) operates to modify and/or reduce the acoustic amplitude of a gunshot.

Typical methods for attaching muzzle accessories to firearm barrels have proved unsatisfactory. For instance, some muzzle accessories are provided with threaded holes that allow them to be screwed onto threaded barrels using high torque. Shims or crush washers are used to allow for proper alignment of such devices while maintaining adequate torquing force during installation. In other instances, one or more set screws are provided to apply lateral frictional forces to barrels to prevent rotation of muzzle accessories after alignment. These attachment methods, however, require specialized tools and bracing equipment to stabilize firearms during installation or removal of muzzle accessories. They are also time consuming, semi-permanent and may not be suitable in situations requiring frequent removal and/or replacement of muzzle accessories, as new shims/washers, careful alignment and retorquing are required for each installation. Repeated tightening of set screws after each installation may also result in stripping of the set screws and/or damage to barrel threads, rendering them ineffective for subsequent use. Such attachment methods also disadvantageously rely on frictional forces to maintain proper alignment of muzzle accessories, rendering them prone to inadvertent rotation or misalignment after repeated use.

There is thus a need for a removable muzzle accessory capable of being quickly and reliably aligned and affixed to a firearm in a toolless (or near toolless) fashion and without need for specialized bracing and other equipment.

BRIEF SUMMARY OF THE INVENTION

Various embodiments of the present invention provide accessorized firearms and muzzle accessories that are capable of quick and easy alignment, installation and removal with little effort and without need for specialized tools. In accordance with an exemplary embodiment of the subject disclosure, an accessorized firearm is provided. The accessorized firearm includes a firearm including a barrel having a main firing tube and a transverse groove; and a muzzle accessory including an accessory body having a through-channel sized to receive the barrel of the firearm, and a locking member structured to engage the groove of the barrel to lock the muzzle accessory to the barrel.

In accordance with an aspect of the subject disclosure, the barrel further includes a cylindrical barrel extension extending distally from the main firing tube, the through-channel of the accessory body includes a barrel receptacle sized to receive the main firing tube of the barrel and an intermediate channel distally of and in communication with the barrel receptacle, the intermediate channel sized to receive the cylindrical barrel extension of the barrel.

In accordance with another aspect of the subject disclosure, the through-channel further includes an exit channel distally of and in communication with the intermediate channel, the exit channel having a diameter approximately equal to a diameter of a firing channel of the barrel.

In accordance with still another aspect of the subject disclosure, a first outside diameter of the cylindrical barrel extension is less than a second outside diameter of the main firing tube.

In accordance with yet another aspect of the subject disclosure, the first outside diameter of the cylindrical barrel extension is about 0.425 inches and the second outside diameter of the main firing tube is about 0.57 inches.

In accordance with still another aspect of the subject disclosure, the barrel further includes a distally facing annular ledge, the accessory body further includes a proximally facing annular wall at a boundary between the barrel receptacle and the intermediate channel, and the muzzle accessory further includes an O-ring positioned within the barrel receptacle between the annular ledge of the barrel and the annular wall of the accessory body.

In accordance with yet another aspect of the subject disclosure, the O-ring is compressed between the annular ledge of the barrel and the annular wall of the accessory body.

In accordance with still another aspect of the subject disclosure, the O-ring biases the accessory body to rotationally align the accessory body with respect to the barrel.

In accordance with yet another aspect of the subject disclosure, the accessory body further includes a lateral through-bore aligned with the groove of the barrel and the locking member includes a locking pin to engage the through-bore and the groove of the barrel.

In accordance with still another aspect of the subject disclosure, the locking pin includes a circumferential channel and the muzzle accessory further includes a detent spring to engage the circumferential channel.

In accordance with yet another aspect of the subject disclosure, the accessory body further includes a retention receptacle to receive the detent spring.

In accordance with still another aspect of the subject disclosure, the accessory body further includes a threaded bore and the muzzle accessory further includes a set screw within the threaded bore for maintaining the detent spring within the retention receptacle.

In accordance with yet another aspect of the subject disclosure, the accessory body further includes an access channel and the detent spring extends proximally from the retention receptacle into the access channel.

In accordance with still another aspect of the subject disclosure, the through-bore intersects the through-channel and the access channel.

In accordance with yet another aspect of the subject disclosure, the locking pin includes tapered ends.

In accordance with still another aspect of the subject disclosure, at least one side of the circumferential channel is tapered.

In accordance with yet another aspect of the subject disclosure, the firearm further includes a slide having a slot and a barrel receipt hole, the barrel is positioned within the slide and extends distally through the barrel receipt hole of the slide, and the accessory body includes an alignment tab structured to engage the slot of the slide.

In accordance with still another aspect of the subject disclosure, the barrel includes an outer surface provided with a receptacle and the alignment tab includes a lower surface provided with an alignment groove, the accessorized firearm further comprising an alignment key within the receptacle of the barrel, the alignment key being received by the alignment groove of the alignment tab.

In accordance with another exemplary embodiment of the subject disclosure, a muzzle accessory for installation on a barrel of a firearm is provided. The muzzle accessory includes an accessory body having a through-channel sized to receive a barrel of a firearm; and a locking member structured to engage the groove of the barrel to lock the muzzle accessory to the barrel.

In accordance with an aspect of the subject disclosure, the through-channel of the accessory body includes a barrel receptacle sized to receive the main firing tube of the barrel and an intermediate channel distally of and in communication with the barrel receptacle, the intermediate channel sized to receive the barrel extension of the barrel.

In accordance with still another aspect of the subject disclosure, the through-channel further includes an exit channel distally of and in communication with the intermediate channel, the exit channel having a diameter sized to approximately match a diameter of a firing channel of the barrel.

In accordance with yet another aspect of the subject disclosure, the accessory body further includes a proximally facing annular wall at a boundary between the barrel receptacle and the intermediate channel, the muzzle accessory further comprising an O-ring sized to be received within the barrel receptacle adjacent to the annular wall.

In accordance with still another aspect of the subject disclosure, the O-ring is constructed from a polymer capable of withstanding high temperatures.

In accordance with yet another aspect of the subject disclosure, the accessory body further includes a lateral through-bore positioned to align with the groove of the barrel when the barrel is received within the barrel receptacle of the accessory body, and the locking member includes a locking pin structured to engage the through-bore and the groove of the barrel.

In accordance with still another aspect of the subject disclosure, the locking pin includes a circumferential channel and the muzzle accessory further includes a detent spring positioned to engage the circumferential channel when the locking pin is inserted into the through-bore.

In accordance with yet another aspect of the subject disclosure, the accessory body further includes a retention receptacle sized to receive the detent spring.

In accordance with still another aspect of the subject disclosure, the accessory body further includes a threaded bore, the muzzle accessory further comprising a set screw within the threaded bore for maintaining the detent spring within the retention receptacle.

In accordance with yet another aspect of the subject disclosure, the accessory body further includes an access channel and the detent spring extends proximally from the retention receptacle into the access channel.

In accordance with still another aspect of the subject disclosure, the through-bore intersects the through-channel and the access channel.

In accordance with yet another aspect of the subject disclosure, the locking pin includes tapered ends and at least one side of the circumferential channel is tapered.

In accordance with still another aspect of the subject disclosure, the accessory body further includes an alignment tab structured to engage with a slot of a slide of the firearm.

In accordance with yet another aspect of the subject disclosure, the alignment tab includes a lower surface provided with an alignment groove sized to receive an alignment key of the barrel.

In accordance with still another aspect of the subject disclosure, the accessory body includes a sight-receipt hole to receive a front sight.

In accordance with yet another aspect of the subject disclosure, the accessory body includes an access window sized to receive a tool for affixing the front sight to the access body using a sight screw.

BRIEF DESCRIPTION OF THE SEVERAL VIEWS OF THE DRAWINGS

The following detailed description of an exemplary embodiment of the subject disclosure will be better understood when read in conjunction with the appended drawings. For the purpose of illustrating the present disclosure, there is shown in the drawings an exemplary embodiment. It should be understood, however, that the subject application is not limited to the precise arrangements and instrumentalities shown.

DETAILED DESCRIPTION OF THE INVENTION

Figure 1:
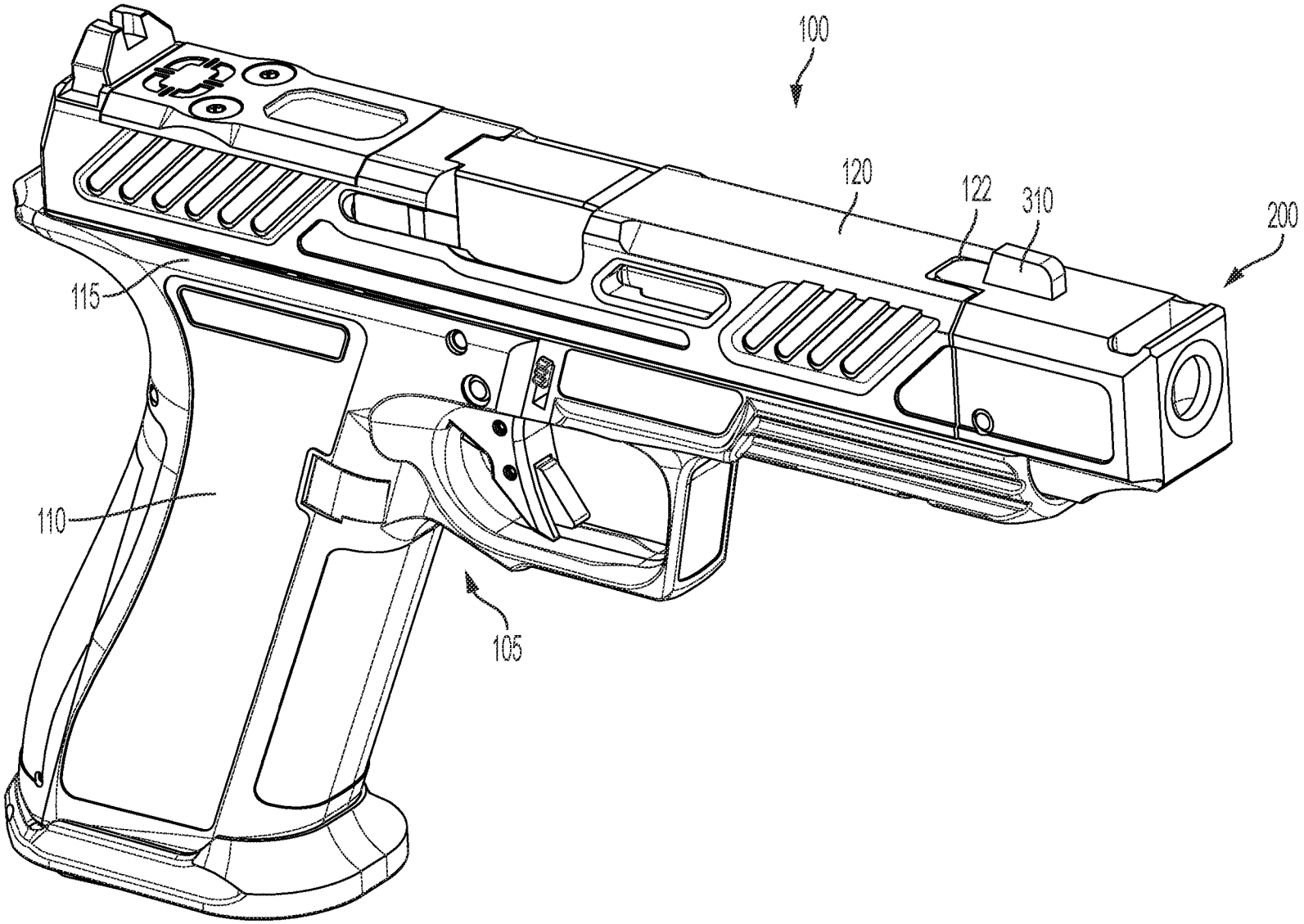
FIG. 1 is a perspective view of an accessorized firearm in accordance with an exemplary embodiment of the subject disclosure.

Reference will now be made in detail to an exemplary embodiment of the subject disclosure illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as upper, lower, top, bottom, above, below and diagonal, are used with respect to the accompanying drawings. Such directional terms used in conjunction with the following description of the drawings should not be construed to limit the scope of the subject disclosure in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art.

"Exemplary" as used herein shall mean serving as an example.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more exemplary embodiments. One skilled in the relevant art will recognize, in light of the description herein, that the subject disclosure can be practiced without one or more of the specific features or advantages of a particular exemplary embodiment. In other instances, additional features and advantages may be recognized in certain exemplary embodiments that may not be present in all exemplary embodiments of the present disclosure.

Referring now to the Figures, there is shown an exemplary accessorized firearm 100 and muzzle accessory 200 in accordance with the present invention. Accessorized firearm 100 includes a firearm or handgun 105 with muzzle accessory 200 (e.g., a compensator, flash suppressor or silencer) coupled to handgun 105. Muzzle accessory 200 illustrated in the Figures is a compensator (or muzzle brake), though it should be appreciated that muzzle accessory 200 may be a flash suppressor, silencer or other muzzle device, and that various embodiments described and claimed herein are not intended to be limited to any particular type(s) of muzzle accessories. It should also be appreciated that muzzle accessory 200 may be used with other types of firearms, such as, for example, rifles and shotguns, and that various embodiments described and claimed herein are not intended to be limited in use to any specific type(s) of firearms.

Figure 2:
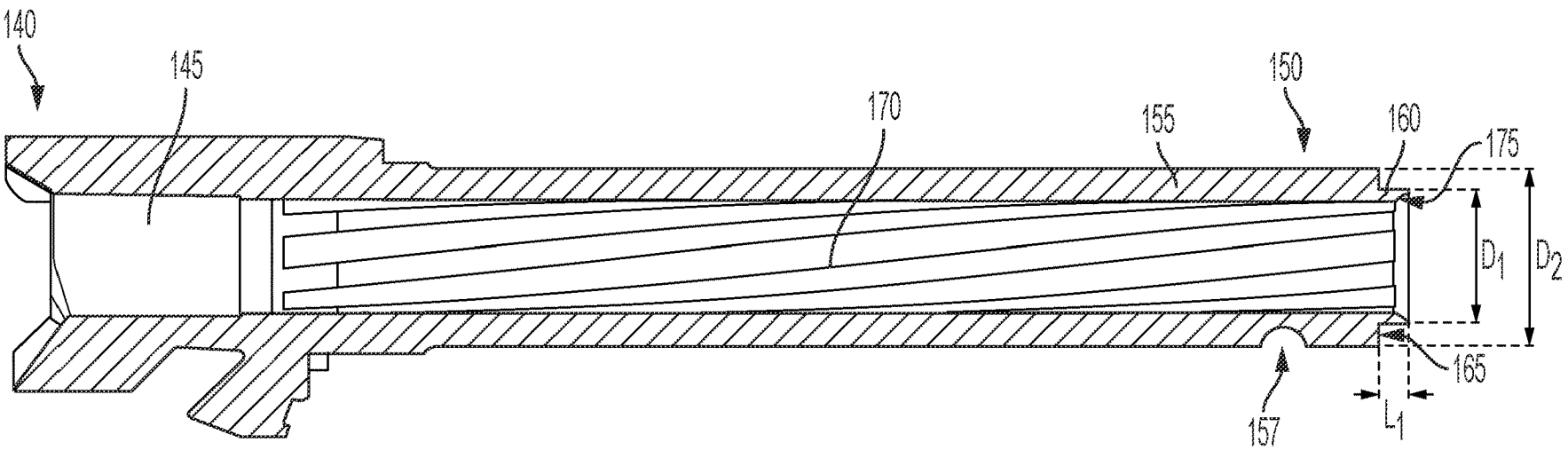
FIG. 2 is a side sectional view of a barrel of the accessorized firearm of FIG. 1.
Figure 3:
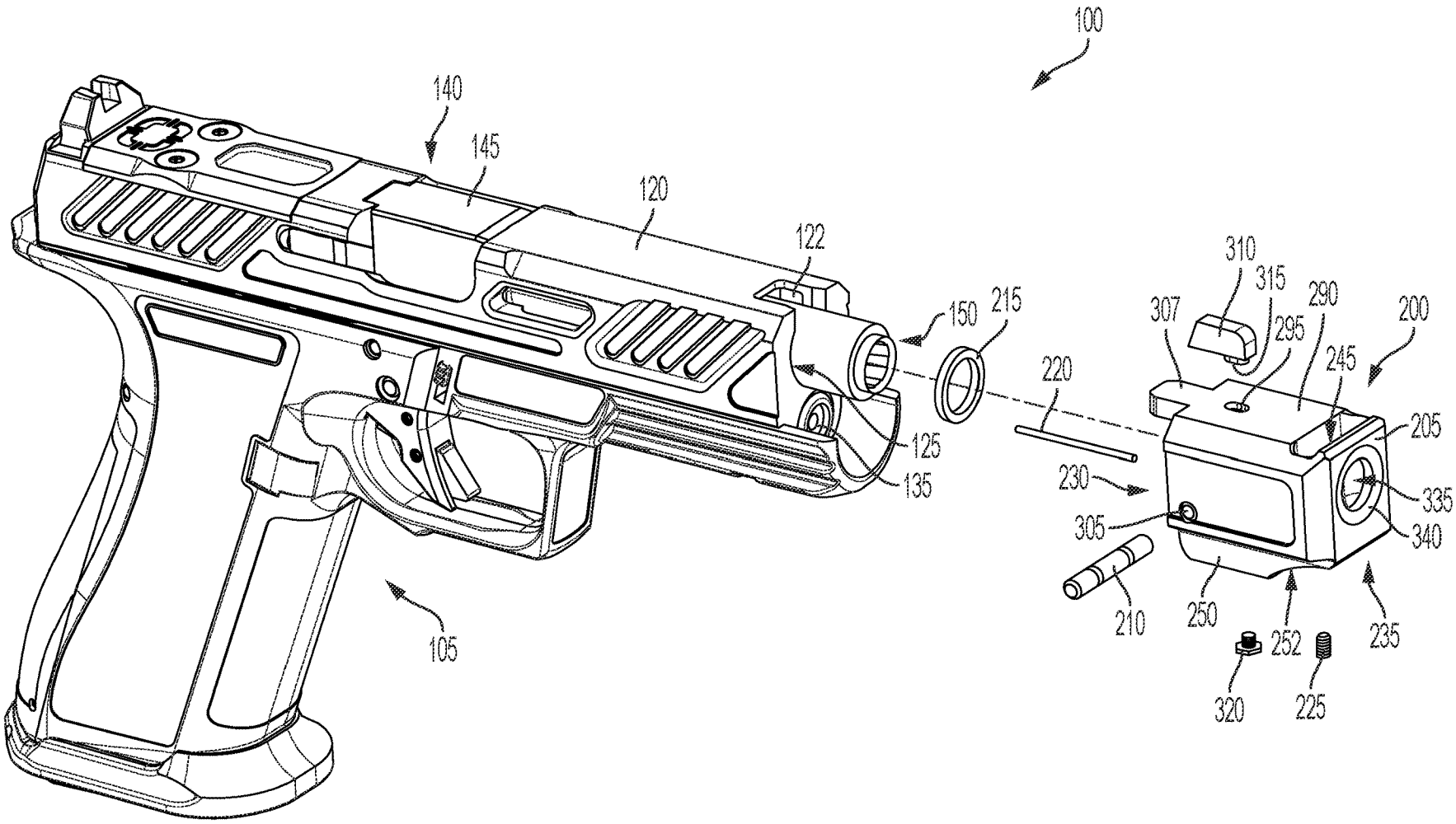
FIG. 3 is a perspective exploded view of the accessorized firearm of FIG. 1.
Figure 4:
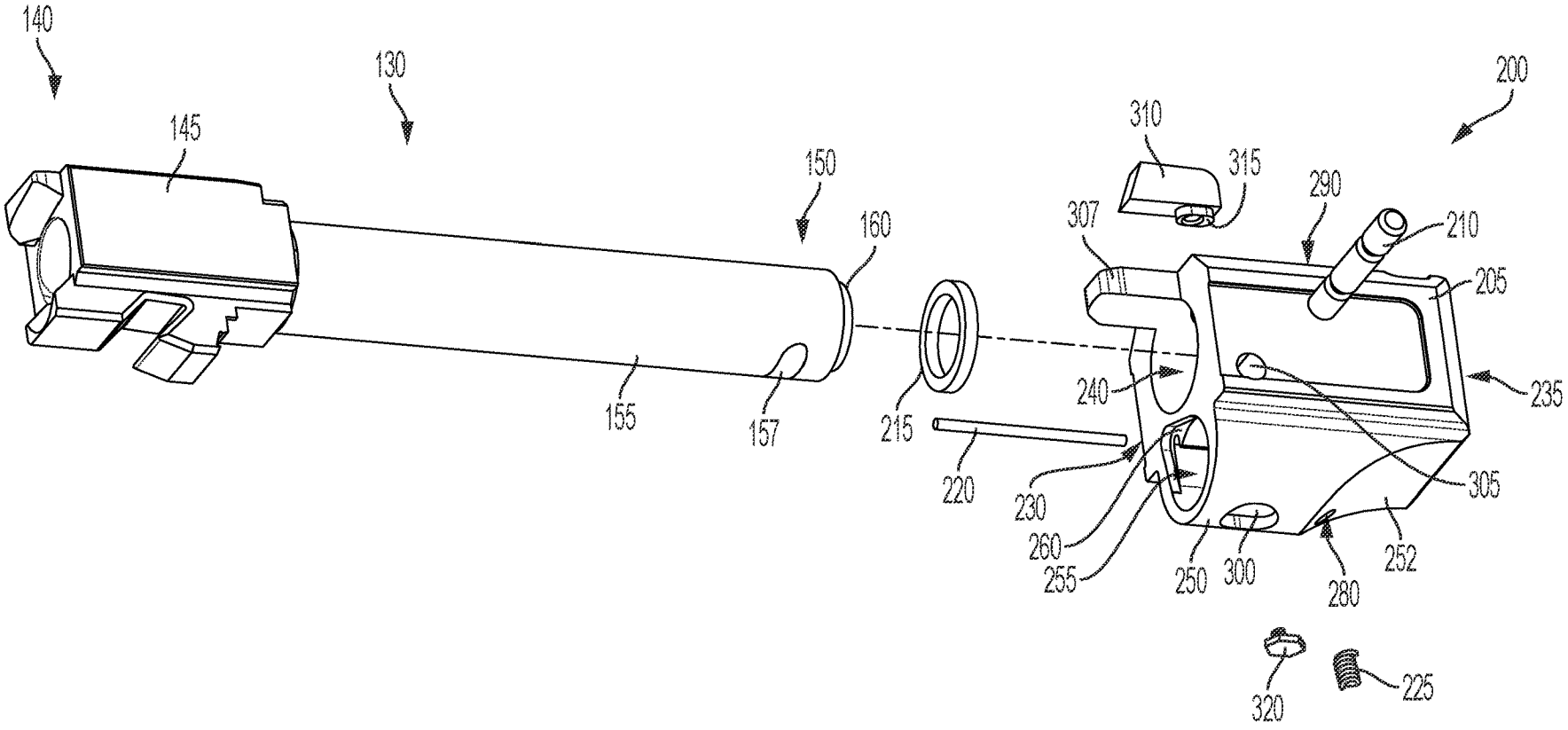
FIG. 4 is a perspective exploded view of a barrel and muzzle accessory of the accessorized firearm of FIG. 1.
Figure 5:
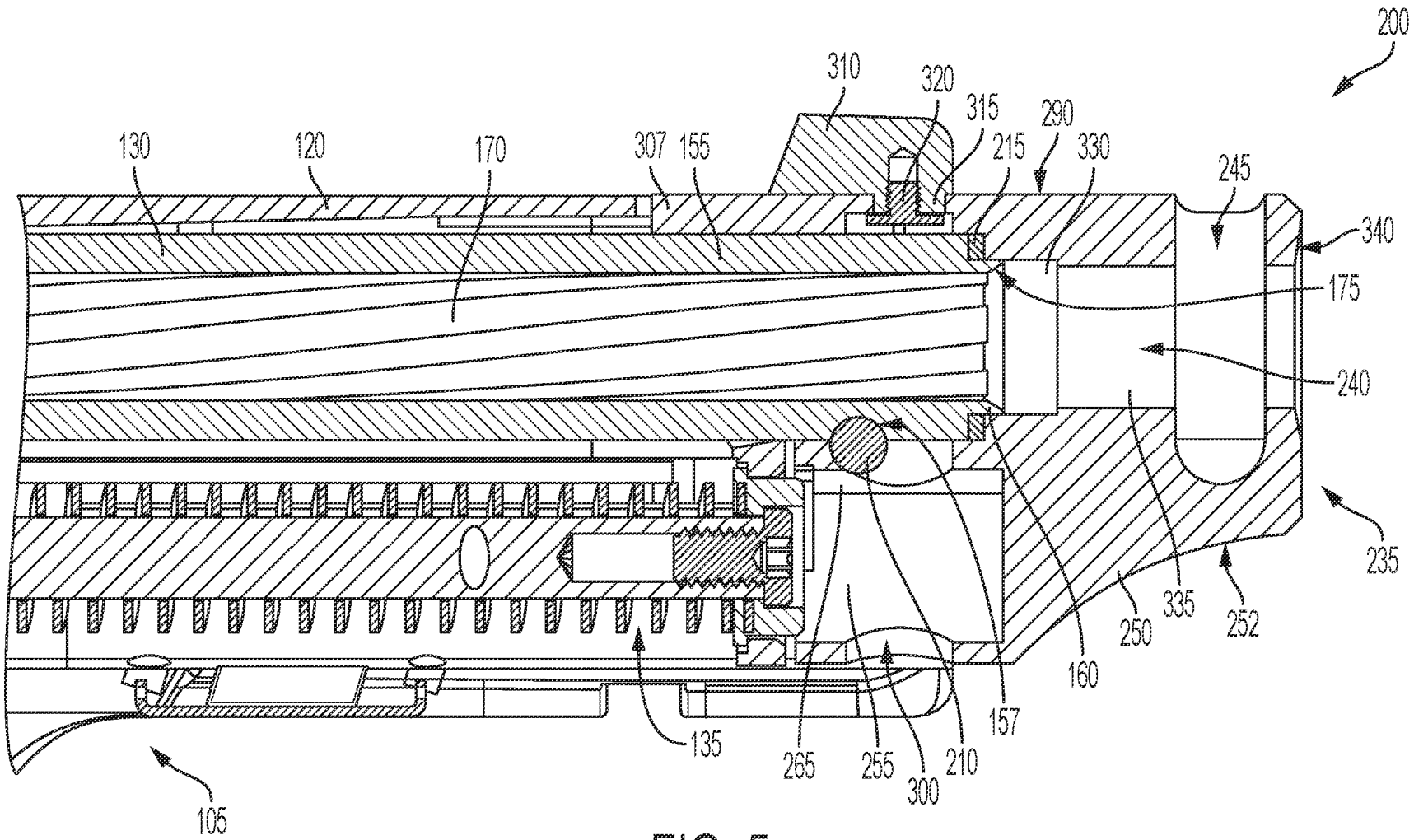
FIG. 5 is an enlarged side sectional view of a distal end of the accessorized firearm of FIG. 1.
Figure 6:
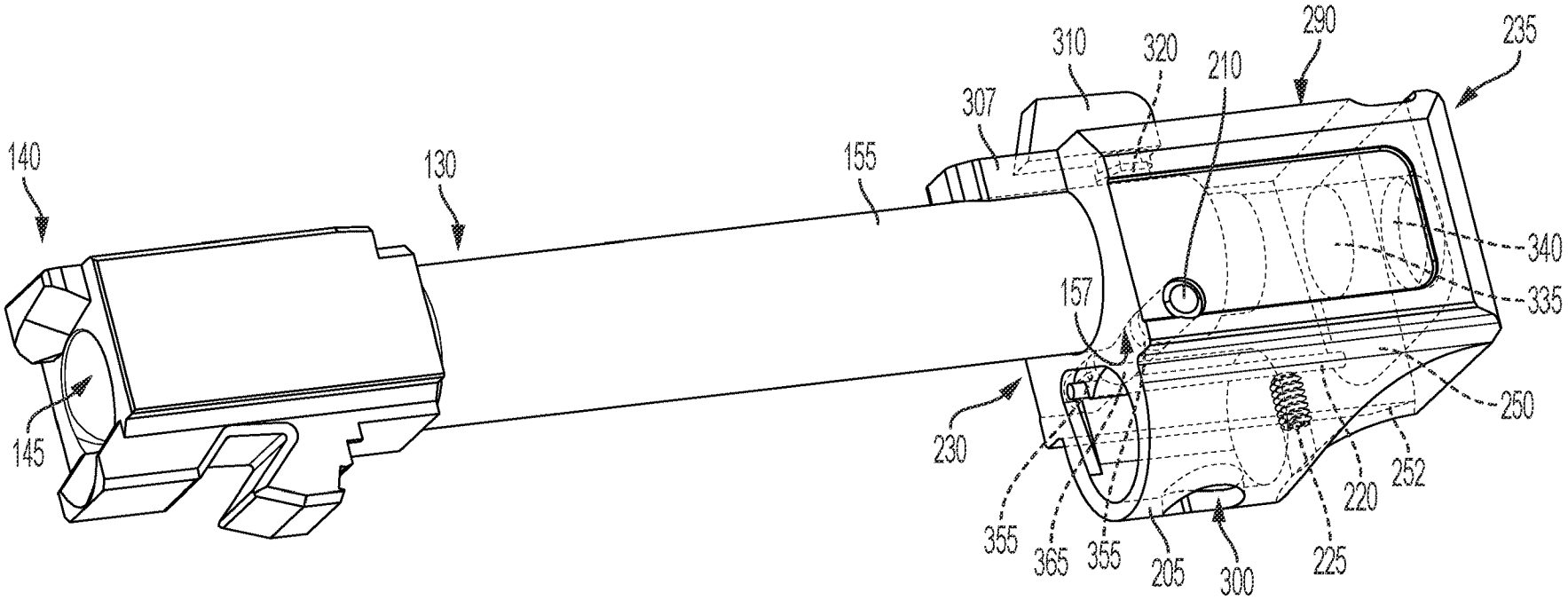
FIG. 6 is a perspective view of the barrel and muzzle accessory of FIG. 4.
Figure 7:
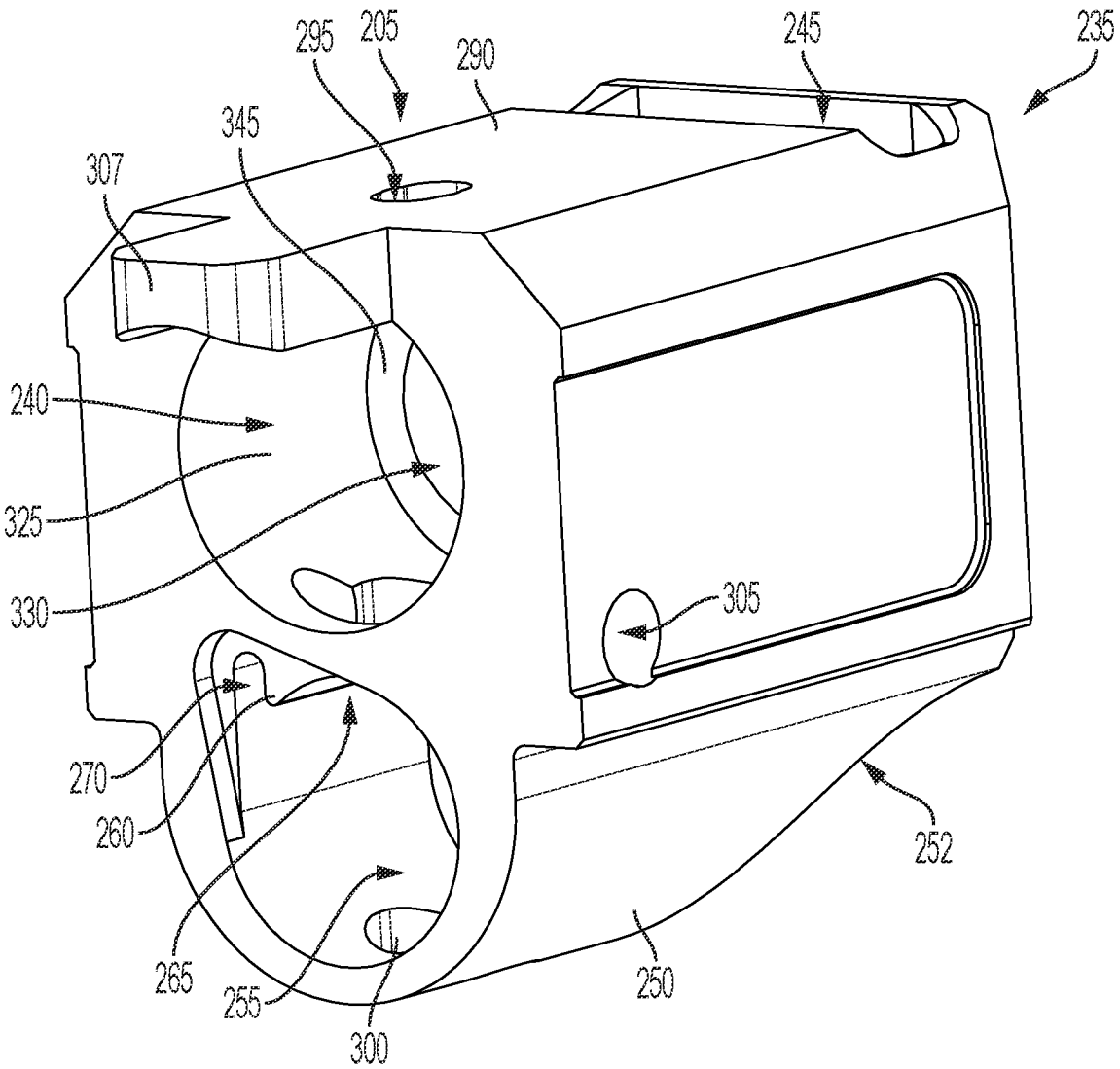
FIG. 7 is a perspective view of an accessory body of the muzzle accessory of FIG. 4.
Figure 8:
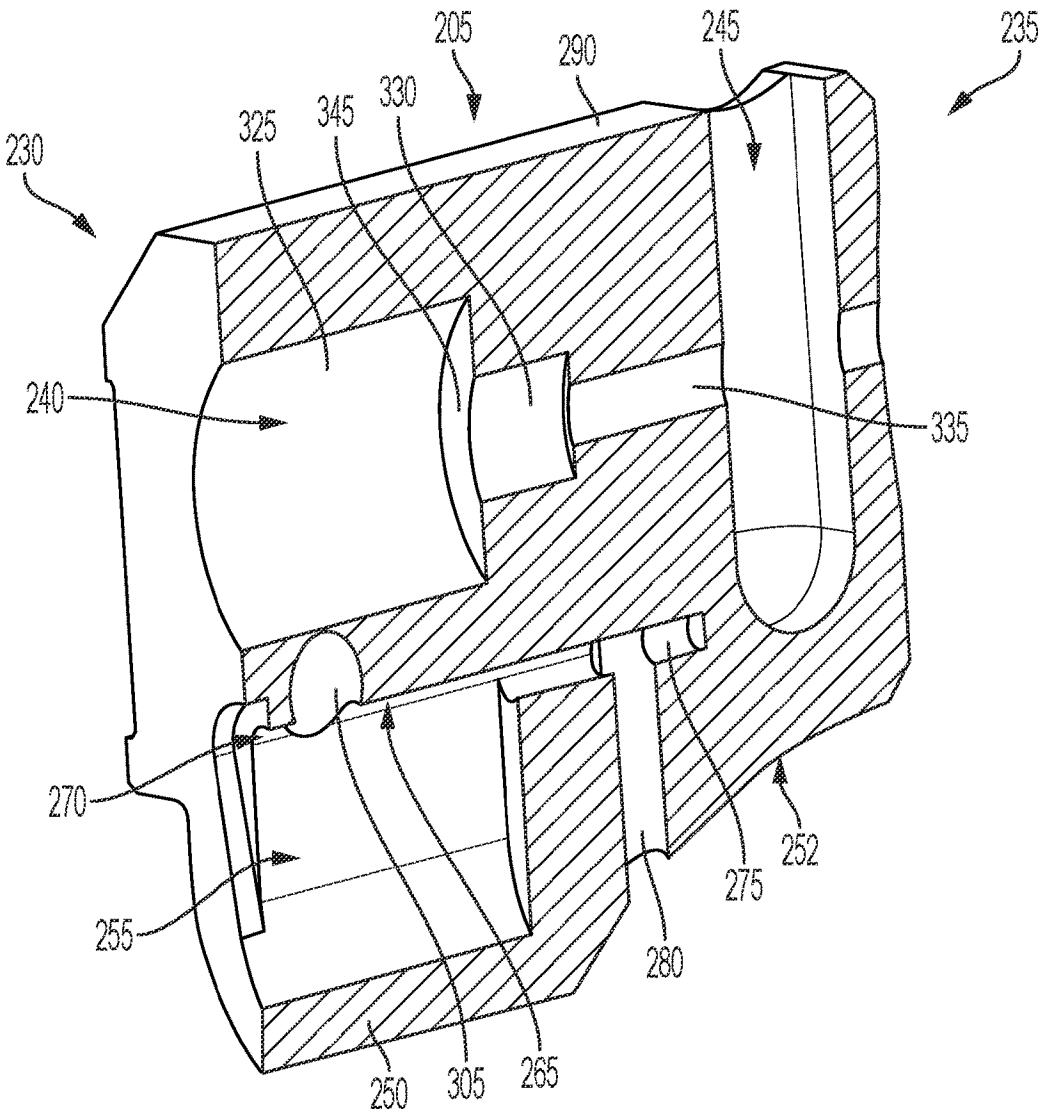
FIG. 8 is an off-center perspective sectional view of the accessory body of FIG. 4.

As best shown in FIGS. 1-3, handgun 105 of accessorized firearm 100 includes a standard receiver assembly 110 having a top side 115, a slide 120 coupled to top side 115 of receiver assembly 110 and having a U-shaped slot 122 and barrel receipt hole 125, a barrel 130 positioned within slide 120 and extending distally through barrel receipt hole 125, and a recoil spring assembly 135 positioned within slide 120. Handgun 105 also includes other well-known components and structures that are not shown or described herein.

Barrel 130 of handgun 105 includes a proximal end 140 having a chamber 145 for receiving rounds/projectiles to be fired and a distal end 150 having a substantially cylindrical main firing tube 155, a transverse groove 157 on a bottom outside surface of main firing tube 155 extending transversely to the longitudinal axis of barrel 130, and a cylindrically shaped barrel extension 160 coaxial with main firing tube 155 and extending distally therefrom by a predetermined length L1 (see FIG. 2). As best shown in FIG. 2, an outside diameter D1 of barrel extension 160 is less than an outside diameter D2 of main firing tube 155, thereby forming a distally facing annular ledge 165 at the boundary between main firing tube 155 and barrel extension 160. In some embodiments, outside diameter D1 of barrel extension 160 is approximately equal to 0.425 inches, outside diameter D2 of main firing tube 155 is approximately equal to 0.570 inches and length L1 of barrel extension 160 is approximately equal to 0.095 inches, though it should be appreciated that any or all of these features may be dimensioned differently. The inside diameters of main firing tube 155 and barrel extension 160 are substantially identical and together form a continuous longitudinal and rifled firing channel 170 terminating at a tapered outlet 175.

In the embodiments illustrated in the Figures, transverse groove 157 intersects the bottom outside surface of barrel 130, has a semi-circular cross section and extends approximately perpendicularly to the longitudinal axis of barrel 130 without intersecting firing channel 170. It should be appreciated, however, that transverse groove 157 may have a different cross-sectional shape (such as square or triangular) and may be wider and/or longer, depending on the dimensions of barrel 130. It should also be appreciated that transverse groove 157 and barrel extension 160 may be formed during manufacture of barrel 130 (such as when barrel 130 is designed specifically to engage with muzzle accessory 200) or, alternatively, may be formed by milling material from the distal end of a standard handgun barrel (or other firearm barrel) to provide after-market compatibility with muzzle accessory 200 and other muzzle accessories described and/or contemplated by the subject disclosure.

As best shown in FIGS. 3-8, muzzle accessory 200 includes an accessory body 205, a front sight 310 secured to accessory body 205 with a sight screw 320, and various mating parts for removably affixing accessory body 205 to barrel 130 of handgun 105, including locking-pin 210, O-ring 215, detent spring 220 and set screw 225.

Accessory body 205 of muzzle accessory 200 includes a proximal end 230, a distal end 235, a top outer surface 290 having a sight-receipt hole 295 sized to receive a keyed portion 315 of front sight 310, a through-channel 240 extending longitudinally between proximal and distal ends 230, 235, a transverse and upwardly facing vent 245 communicating with through-channel 240 at distal end 235, a bottom portion 250 having an access window 300 communicating with a blind access channel 255 extending distally and substantially parallel to through-channel 240 from proximal end 230, a sloping lip 260 protruding downwardly from a top side 265 of access channel 255 and forming a retention groove 270, a blind retention receptacle 275 communicating with and extending distally from retention groove 270, a threaded bore 280 intersecting retention receptacle 275 and extending transversely therefrom to an outside curved surface 252 of bottom portion 250, a through-bore 305 extending laterally and completely through proximal end 230 between and intersecting through-channel 240 and access channel 255, and a U-shaped alignment tab 307 at proximal end 230.

Through-channel 240 of accessory body 205 includes a barrel receptacle 325 at proximal end 230. Barrel receptacle 325 is substantially cylindrical and has a diameter approximately equal to (but slightly larger than) diameter D2 of main firing tube 155 of barrel 130, thereby allowing barrel receptacle 325 to closely receive barrel 130. Through-channel 240 also includes a proximally facing annular wall 345 at the distal end of barrel receptacle 325, an intermediate channel 330 in communication with barrel receptacle 325 and sized to closely receive barrel extension 160 of barrel 130 (i.e., intermediate channel 330 has a diameter approximately equal to, but slightly larger than, diameter D1 of barrel extension 160), and an exit channel 335 having a tapered end 340 and a diameter approximately equal to that of firing channel 170 of barrel 130. In this manner, firing channel 170 of barrel 130 and exit channel 335 of accessory body 205 form a substantially continuous channel for a fired projectile when muzzle accessory 200 is affixed to handgun 105.

Figure 9:
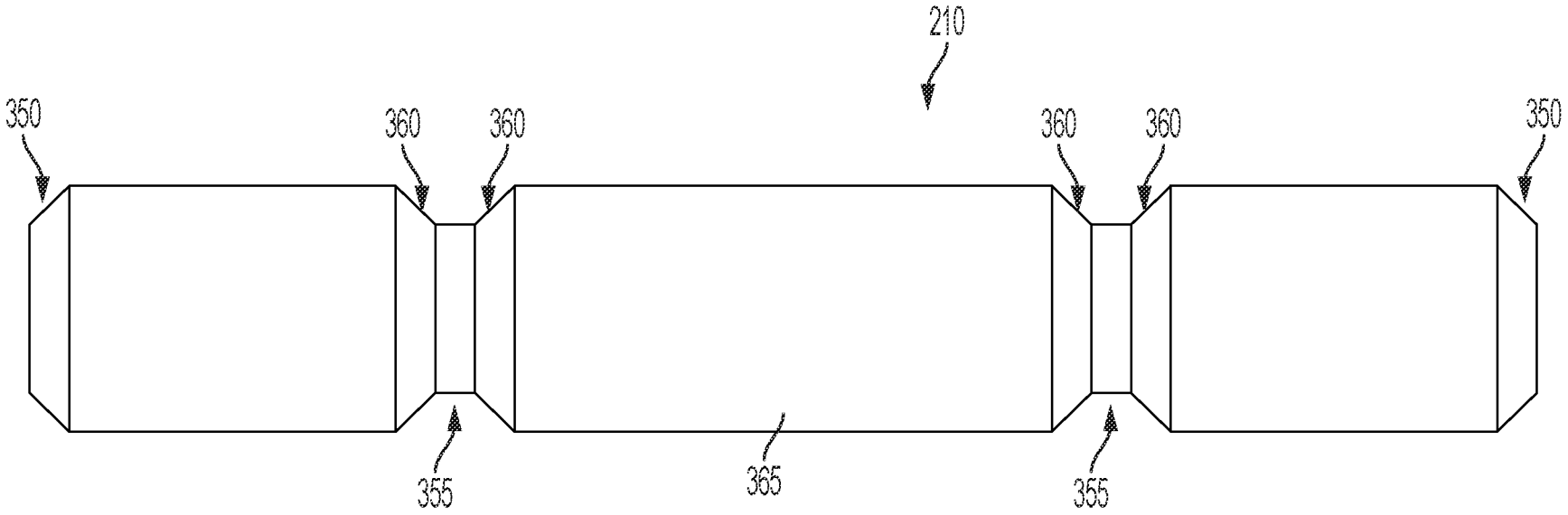
FIG. 9 is a side view of a locking pin of the muzzle accessory of FIG. 4.

Locking pin 210 is a cylindrically-shaped locking member positioned within through-bore 305 of accessory body 205. As best shown in FIG. 9, locking pin 210 includes tapered ends 350, a center portion 365, and two circumferential channels 355 with tapered sides 360 at respective ends of center portion 365. Center portion 365 engages with groove 157 of barrel 130 to prevent both removal of accessory body 205 from barrel 130 and rotation of accessory body 205 about and with respect to barrel 130.

Figure 15B:
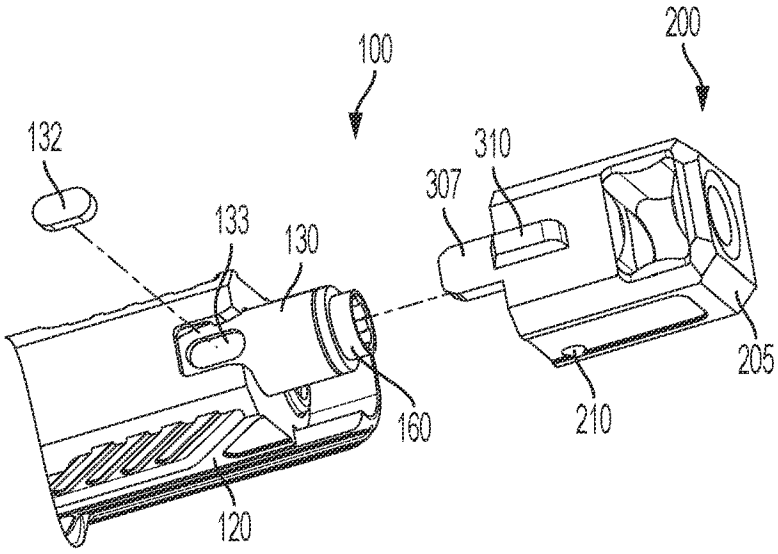
FIG. 15B is another top perspective exploded view of the distal end of the accessorized firearm of FIG. 15A.
Figure 15A:
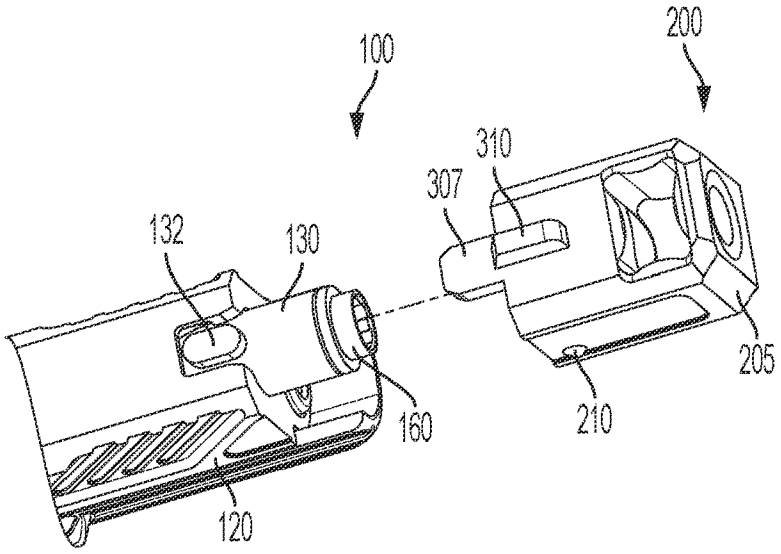
FIG. 15A is a top perspective exploded view of the distal end of an accessorized firearm in accordance with another exemplary embodiment of the subject disclosure.
Figure 15C:
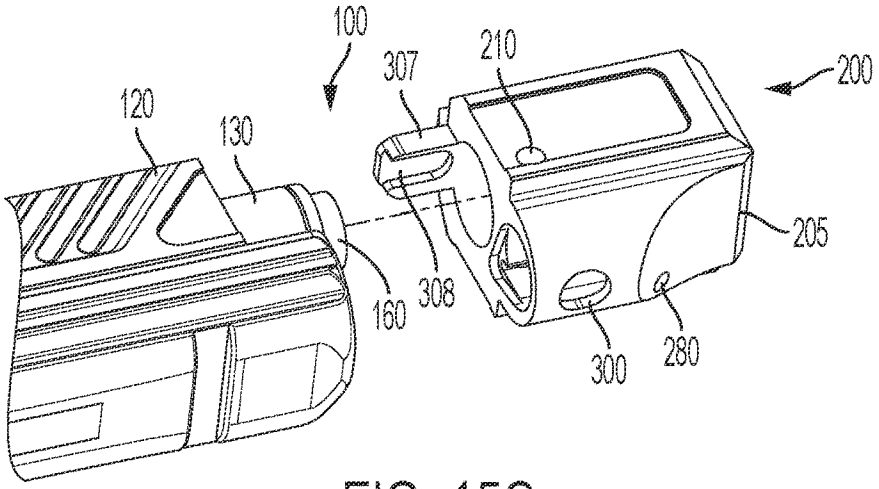
FIG. 15C is a bottom perspective exploded view of the distal end of the accessorized firearm of FIG. 15A.

U-shaped alignment tab 307 of accessory body 205 engages with slot 122 of slide 120 to assist in properly aligning accessory body 205 relative to accessorized firearm 100 and preventing rotation of accessory body 205 with respect to barrel 130. As shown in the embodiment illustrated in FIGS. 15A-15C, proper rotational alignment of accessory body 205 with respect to barrel 130 may be facilitated by providing barrel 130 with an alignment key 132 structured to mate closely with an alignment groove 308 on the lower side of U-shaped alignment tab 307. Alignment key 132 may be constructed, for example, from a polymeric or other suitable material and be press-fit into a corresponding receptacle 133 milled into the top outer surface of barrel 130. In an alternative embodiment, alignment key 132 is formed integrally with barrel 130 during manufacture.

Figure 13:
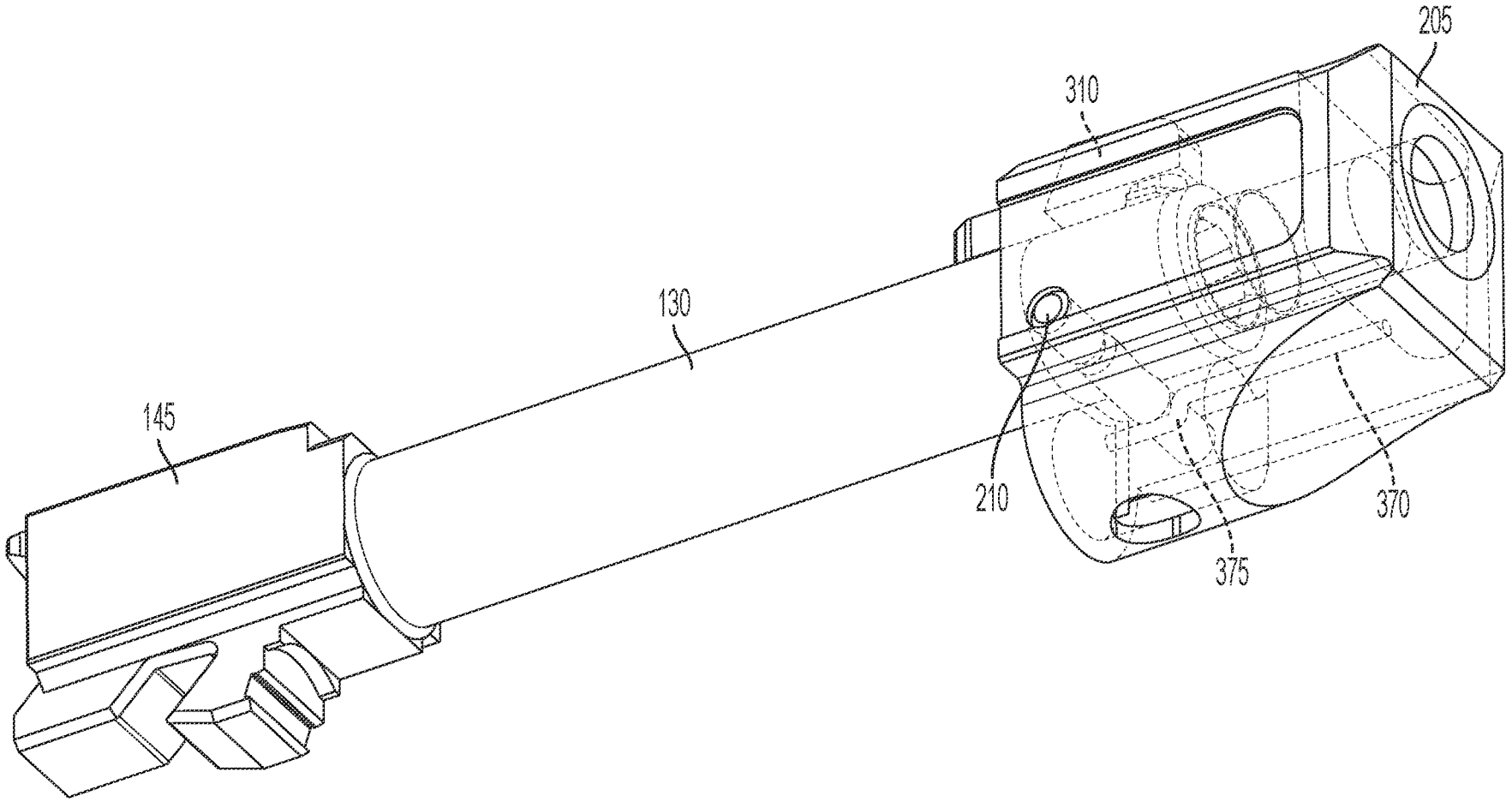
FIG. 13 is a perspective view of a barrel, accessory body, locking pin, and curved detent spring in accordance with another exemplary embodiment of the subject disclosure.
Figure 14:
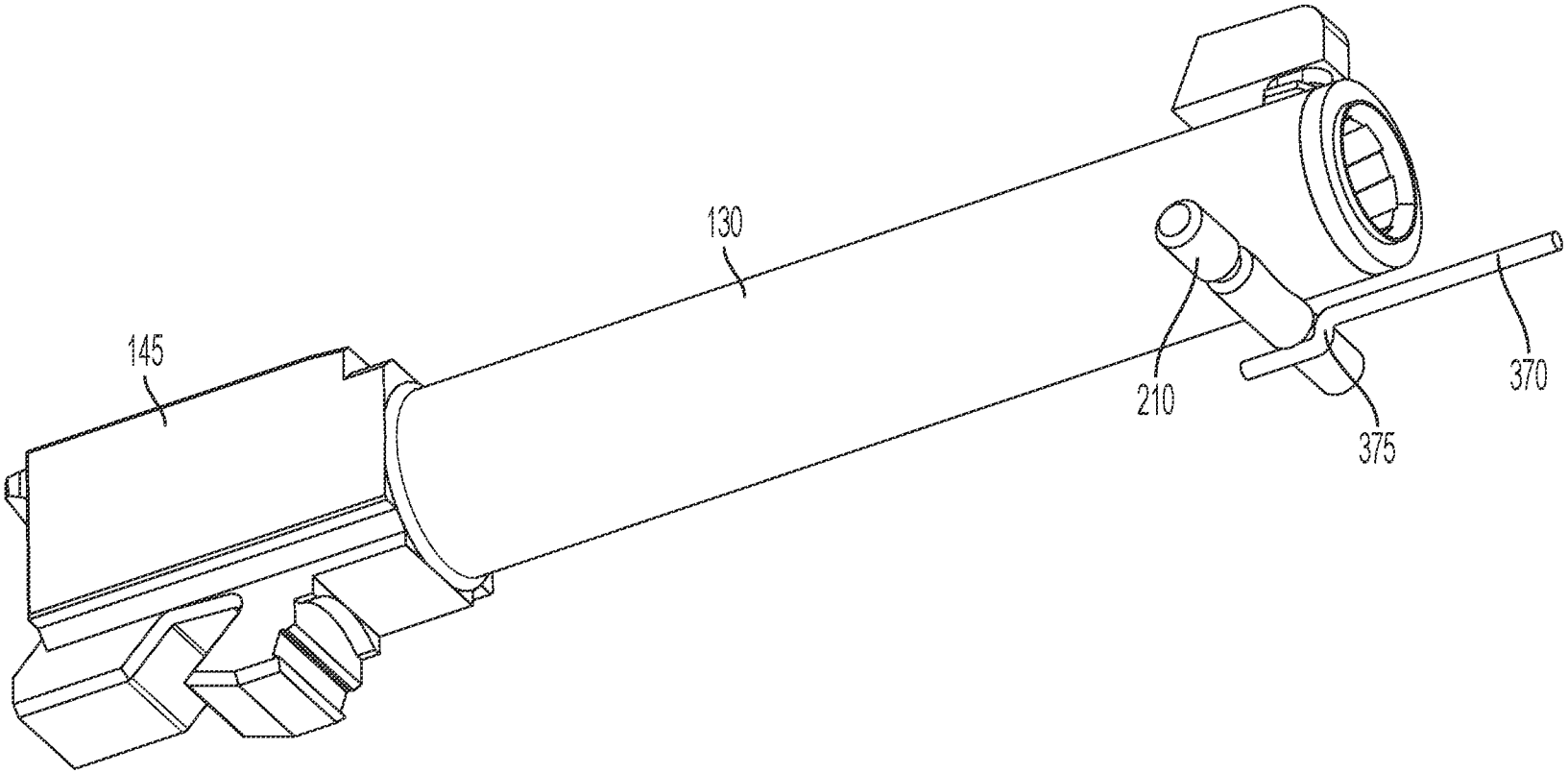
FIG. 14 is another perspective view of the barrel, locking pin, and curved detent spring illustrated in FIG. 13.

Inadvertent removal of locking pin 210 laterally from accessory body 205 is prevented by a pin-like detent spring 220, which extends proximally from retention receptacle 275 through retention groove 270 where it engages one of circumferential channels 355 of locking pin 210. Set screw 225 in threaded bore 280 maintains detent spring 220 firmly within retention receptacle 275 to prevent inadvertent removal thereof from accessory body 205, though it should be appreciated that retention receptacle 275 may be sized to frictionally maintain detent spring 220 in position (such as, e.g., via a press-fit), thereby obviating the need for set screw 225 and threaded bore 280. Set screw 225 and threaded bore 280 may be dispensed with also in other embodiments, such as those that include a bent detent spring 370 having a vertical portion 375 positioned to engage locking pin 210 to prevent spring 370 from displacing proximally and out of retention receptacle 275 (see FIGS. 13 and 14). It should also be appreciated that detent springs 220, 370 may be replaced by other types of springs or biasing members, or other types of fasteners or structures altogether, and that various embodiments described and/or claimed herein are not intended to be limited to any particular structure or mechanism for maintaining locking pin 210 within through-bore 305.

O-ring 215 is positioned at the distal end of barrel receptacle 325. O-ring 215 is maintained under compression between annular wall 345 of accessory body 205 and annular ledge 165 of barrel 130 when through-bore 305 aligns with groove 157 of barrel 130 to receive locking pin 210. In this manner, O-ring 215 forms a gas-tight seal that prevents discharge gasses expelled from distal end 150 of barrel 130 from escaping accessory body 205 proximally along the boundary between the outer surface of barrel 130 and the inner surface of barrel receptacle 325. Biasing forces exerted by O-ring 215 under compression also help retain locking pin 210 within through-bore 305 by producing frictional engagement between locking pin 210 and the distal side of groove 157 of barrel 130, as well as between locking pin 210 and the proximal side of through-bore 305. Frictional engagement between locking pin 210 and the distal side of groove 157 also advantageously forces accessory body 205 into proper rotational alignment to the extent tolerances in fit among pin 210, groove 157 and/or through-bore 305 allow for rotational play and potential misalignment of accessory body 205 with respect to barrel 130. In at least some embodiments, O-ring 215 is formed from a polymer capable of withstanding high temperatures associated with discharge gasses and/or compression over extended periods of time without losing substantial elasticity.

O-ring 215 may be dispensed with to the extent O-ring 215 is optional, not required or otherwise undesirable. This may be the case, for example, where a gas-tight seal is unnecessary due to tight tolerances in fit between barrel 130 and barrel receptacle 325 and/or tolerances in fit among pin 210, groove 157 and/or through-bore 305 are tight and do not result in substantial rotational play of accessory body 205 with respect to barrel 130. To compensate for rotational play in situations where a gas-tight seal is optional or unnecessary, O-ring 215 may be replaced with an annular wave spring or other biasing member to provide the necessary biasing forces to align accessory body 205 with respect to barrel 130.

Although detent spring 220 engages only one of the circumferential channels 355 of locking pin 210 (referred to as the engaged circumferential channel 355), two channels 355 are provided symmetrically about center portion 365 to allow locking pin 210 to be inserted into through-bore 305 either end 350 first. It should be appreciated, however, that locking pin 210 may include only a single, off-center circumferential channel 355, and that various embodiments described and/or claimed herein are not intended to be limited to any number or orientation of channels 355.

Furthermore, while embodiments described and illustrated herein include substantially cylindrical locking pins 210, through-bores 305, and barrel grooves 157 having corresponding and substantially identical circular cross-sections, it should be appreciated that these features may be shaped to have different cross-sections, such as, for example, square or triangular-shaped cross-sections. A square-shaped cross section may be particularly advantageous, e.g., to provide enhanced alignment and engagement among locking pin 210, barrel 130 and accessory body 205, though it should be appreciated that various embodiments described and/or claimed herein are not intended to be limited to any particular cross-sectional shape(s) of these features. It should also be appreciated that locking pin 210 may include more gradually tapered surfaces at ends 350 and/or sides 360 of circumferential channels 355 to reduce the forces necessary for insertion and removal of locking pin 210 into and from through-bore 305 or, alternatively, may have more aggressively tapered surfaces to improve retention of locking pin 210 within through-bore 305. It should be appreciated, however, that various embodiments described and claimed herein are not intended to be limited to any particular taper at ends 350 and/or sides 360.

Figure 11:
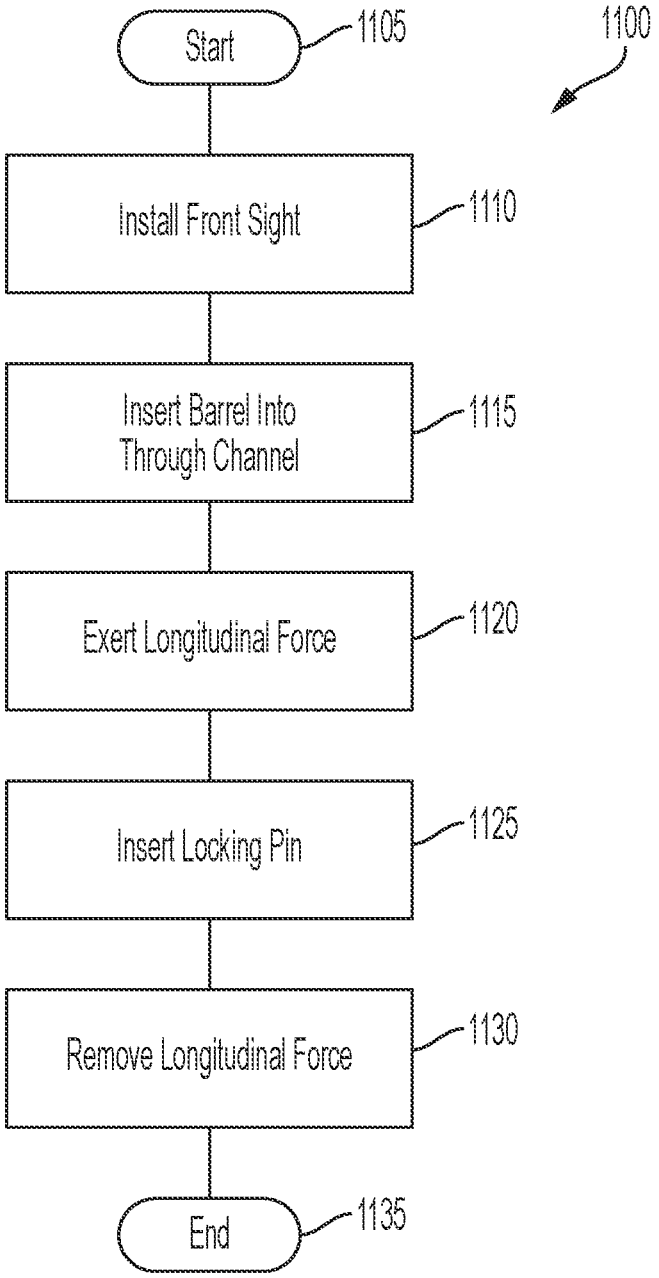
FIG. 11 is a flow diagram of a process for installing the muzzle accessory of FIG. 4 on a firearm.
Figure 12:
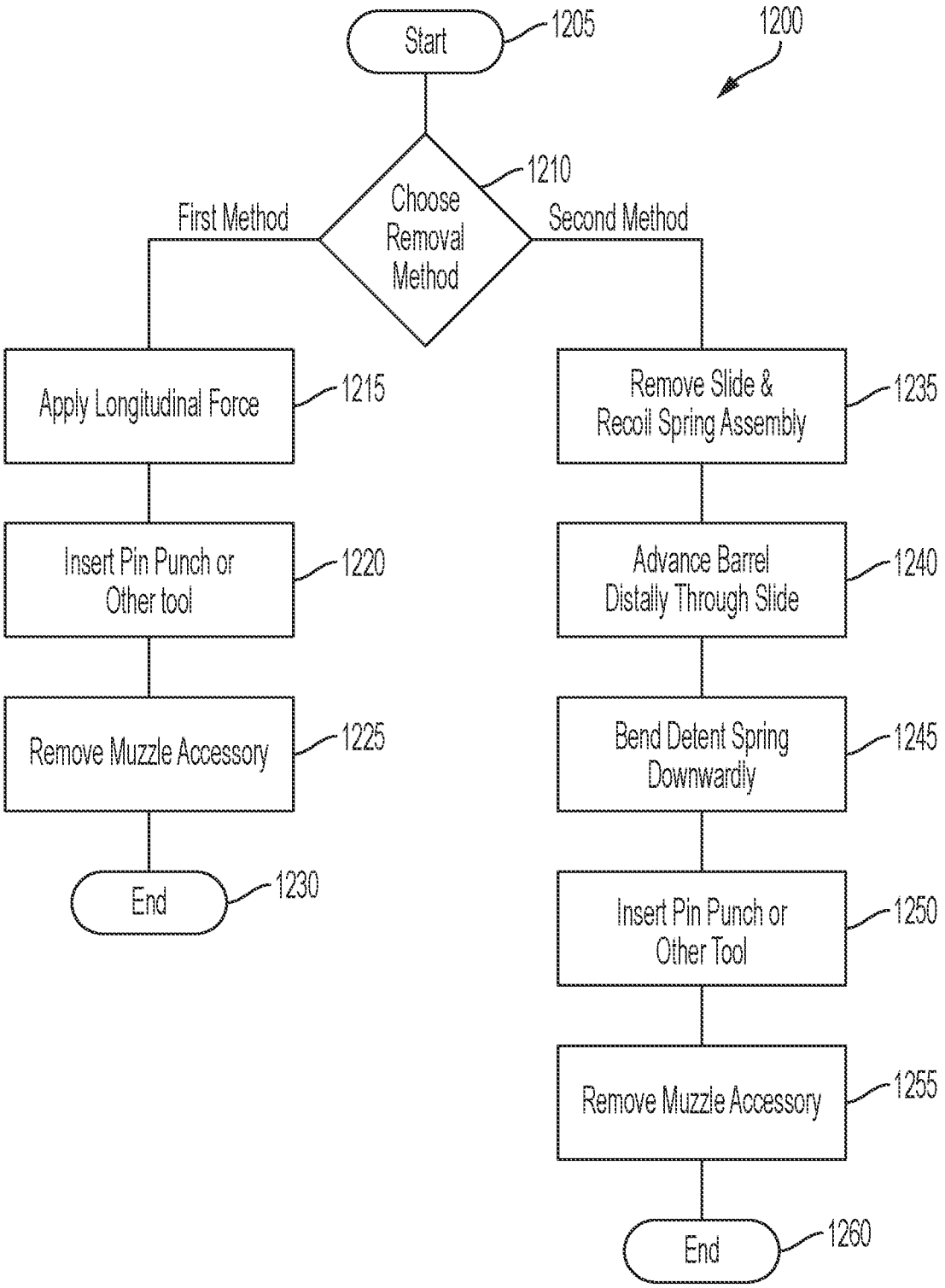
FIG. 12 is a flow diagram of a process for removing the muzzle accessory of FIG. 4 from a firearm.

Referring now to FIG. 11, there is shown a flow diagram of a process 1100 for installing muzzle accessory 200 on handgun 105. The process begins at step 1105 and proceeds to step 1110, at which a user installs front sight 310 to top outer surface 290 of accessory body 205 by inserting keyed portion 315 of front sight 310 into sight-receipt hole 295 and tightening sight screw 320 to lock front sight 310 to accessory body 205. Sight screw 320 may be accessed and tightened from underneath accessory body 205 by inserting a tool (such as a screwdriver) upwardly through access window 300.

After front sight 310 is secured, the process proceeds to step 1115, at which the user inserts barrel 130 into through-channel 240 of accessory body 205 until distal end 150 of barrel 130 engages O-ring 215. Proper rotational orientation of accessory body 205 on barrel 130 is achieved quickly during this step by aligning and engaging U-shaped alignment tab 307 with slot 122 of slide 120. Then, at step 1120, the user exerts a longitudinal force by hand proximally against accessory body 205 to compress O-ring 215 between annular wall 345 of accessory body 205 and annular ledge 165 of barrel 130 and align through-bore 305 of accessory body 205 with groove 157 of barrel 130. The process then proceeds to step 1125, at which the user—while maintaining the longitudinal force against accessory body 205—inserts locking pin 210 into through-bore 305 to lock accessory body 205 to barrel 130. When locking pin 210 is first inserted, a tapered end 350 of pin 210 engages detent spring 220 causing spring 220 to displace downwardly against its biasing force. As insertion of locking pin 210 continues, the outer surface of pin 210 slides across detent spring 220 until one of circumferential channels 355 of pin 210 aligns with detent spring 220. At this point, detent spring 220 biases upwardly into the circumferential channel 355 to maintain pin 210 in place within accessory body 205. At step 1130, the user ceases applying the longitudinal force to accessory body 205, thereby causing biasing forces exerted by O-ring 215 under compression to assist in retaining locking pin 210 within through-bore 305. The process then ends at step 1135.

Referring now to FIG. 1200, there is shown a flow diagram of a process for removing muzzle accessory 200 from handgun 105. The process begins at step 1205 and proceeds to step 1210, at which a user decides which of two methods to employ for removing muzzle accessory 200 from handgun 105. If the user selects the first method, the process proceeds to step 1215. At this step, the user applies a longitudinal force proximally against accessory body 205 to compress O-ring 215 and release the biasing force exerted by O-ring 215 on locking pin 210. The process then proceeds to step 1220, at which, the user—while maintaining the longitudinal force against accessory body 205—inserts a pin punch or other tool (such as a pencil, ball-point pen, or other readily available structure) into either end of through-bore 305 to engage and slide locking pin 210 out of through-bore 305. The force applied by the tool against locking pin 210 causes the tapered side 360 of the active circumferential channel 355 (i.e., the channel 355 intersected by detent spring 220) to engage and displace detent spring 220 downwardly against its biasing force. The pin punch or other tool is then further inserted into through-bore 305 to fully remove locking pin 210 from accessory body 205. The process then proceeds to step 1225, at which the user removes muzzle accessory 200 by sliding it distally off barrel 130 of handgun 105. The process then ends at step 1230.

Figure 10A:
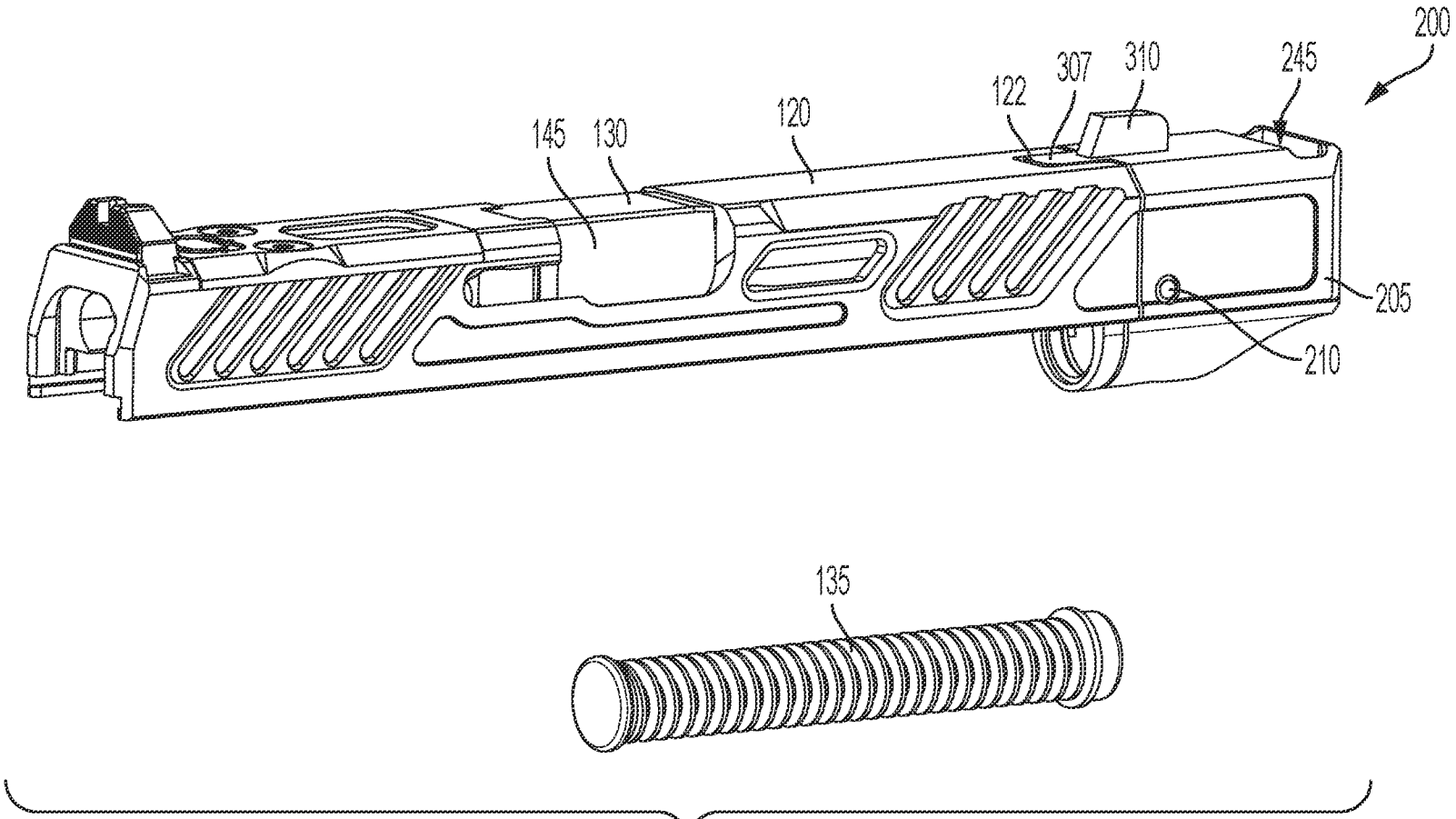
FIG. 10A is perspective exploded view of a slide, barrel, recoil spring assembly and muzzle accessory of the accessorized firearm of FIG. 1.
Figure 10B:
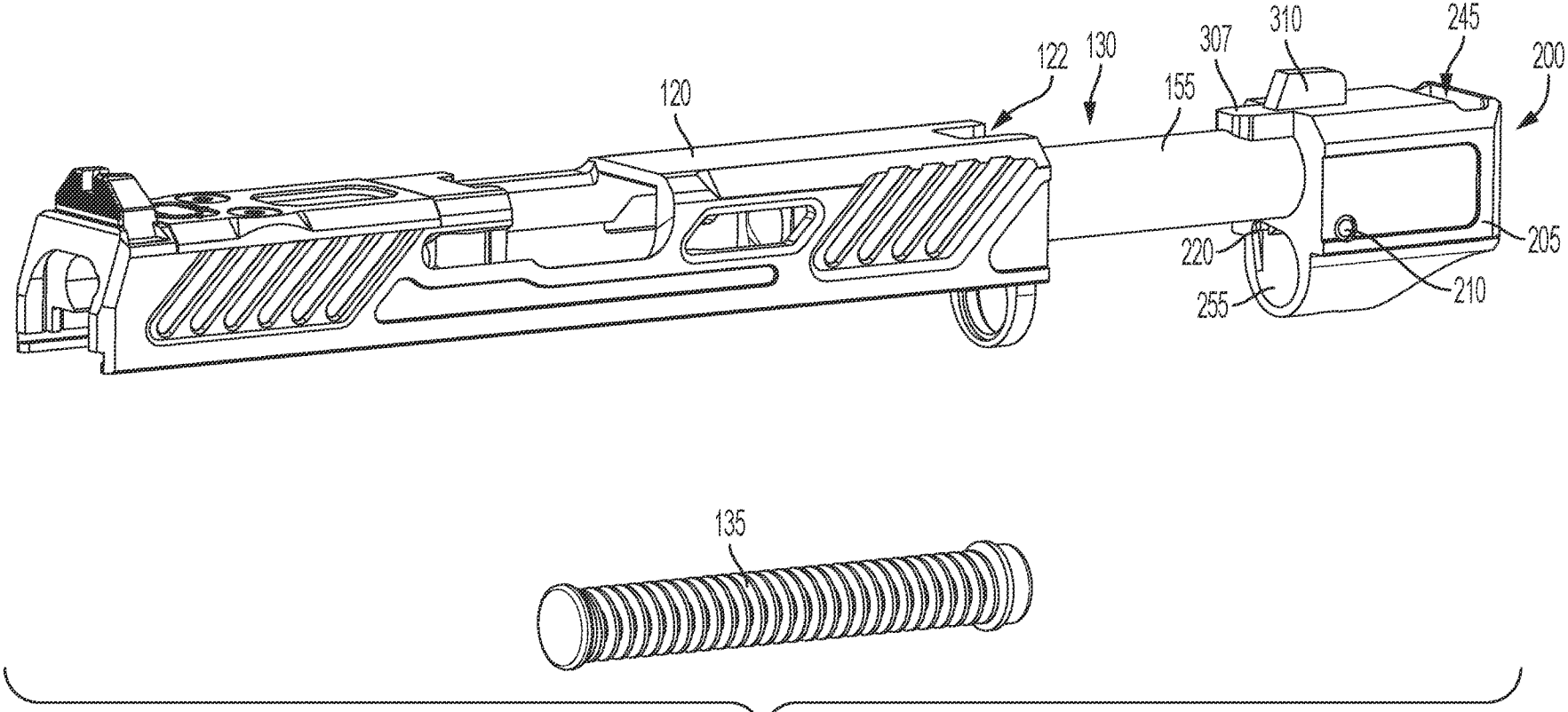
FIG. 10B is perspective exploded view of the slide, barrel, recoil spring assembly and muzzle accessory of FIG. 10B with the barrel extended distally through the slide.

If the user selects the second method of removing muzzle accessory 200 from handgun 105, the process proceeds from step 1210 to step 1235. At step 1235, the user removes slide 120 and recoil spring assembly 135 from handgun 105 in known fashion (see FIG. 10A). The process then proceeds to step 1240, at which the user advances barrel 130 as far distally as possible through barrel receipt hole 125 to expose access channel 255 of accessory body 205 (see FIG. 10B). With access channel 255 exposed, the user employs a finger or tool at step 1245 to manually bend the proximal end of detent spring 220 downwardly until it clears the engaged circumferential channel 355 of locking pin 210. The process then proceeds to step 1250, at which the user—while still bending detent spring 220—inserts a pin punch or other tool into either end of through-bore 305 to engage and slide locking pin 210 out of through-bore 305. To ease removal of pin 210, the user may release the biasing force exerted by O-ring 215 on locking pin 210 by applying a longitudinal force proximally against accessory body 205 while sliding pin 210 out of through-bore 305. In such a circumstance, locking pin 210 may be removed from through-bore 305 without tools by allowing it to slide out of through-bore 305 under force of gravity. To ensure that the longitudinal force applied by the user does not advance barrel 130 proximally into slide 120 during this step, it may be advantageous to brace proximal end 140 of barrel 130 with respect to slide 120, such as, for example, by hand or with a tool, such as a clamp. After locking pin 210 is removed from accessory body 205, the process proceeds to step 1255, at which the user removes muzzle accessory 200 by sliding it distally off barrel 130 of handgun 105. Handgun 105 is then reassembled in known fashion. The process then ends at step 1260.

It should also be appreciated by those skilled in the art that changes may be made to the exemplary embodiments described above without departing from the broad inventive concept thereof. It is to be understood, therefore, that this disclosure is not limited to the particular exemplary embodiments disclosed, but it is intended to cover modifications within the spirit and scope of the claims defined herein.

What is claimed is:

1. An accessorized firearm, comprising:

a firearm including a barrel having a main firing tube and a transverse groove; and a muzzle accessory including:

an accessory body having a through-channel sized to receive the barrel of the firearm and a lateral through-bore aligned with the groove of the barrel, a locking member structured to engage the groove of the barrel to lock the muzzle accessory to the barrel, the locking member including a locking pin to engage the through-bore and the groove of the barrel, the locking pin including a circumferential channel, and a detent spring to engage the circumferential channel.

2. The accessorized firearm of claim 1, wherein the barrel further includes a cylindrical barrel extension extending distally from the main firing tube, the through-channel of the accessory body includes a barrel receptacle sized to receive the main firing tube of the barrel and an intermediate channel distally of and in communication with the barrel receptacle, the intermediate channel sized to receive the cylindrical barrel extension of the barrel.

3. The accessorized firearm of claim 2, wherein the through-channel further includes an exit channel distally of and in communication with the intermediate channel, the exit channel having a diameter approximately equal to a diameter of a firing channel of the barrel.

4. The accessorized firearm of claim 2, wherein a first outside diameter of the cylindrical barrel extension is less than a second outside diameter of the main firing tube.

5. The accessorized firearm of claim 4, wherein the first outside diameter of the cylindrical barrel extension is about 0.425 inches and the second outside diameter of the main firing tube is about 0.57 inches.

6. The accessorized firearm of claim 4, wherein the barrel further includes a distally facing annular ledge, the accessory body further includes a proximally facing annular wall at a boundary between the barrel receptacle and the intermediate channel, and the muzzle accessory further includes an O-ring positioned within the barrel receptacle between the annular ledge of the barrel and the annular wall of the accessory body.

7. The accessorized firearm of claim 6, wherein the O-ring is compressed between the annular ledge of the barrel and the annular wall of the accessory body.

8. The accessorized firearm of claim 6, wherein the O-ring biases the accessory body to rotationally align the accessory body with respect to the barrel.

9. The accessorized firearm of claim 1, wherein the accessory body further includes a retention receptacle to receive the detent spring.

10. The accessorized firearm of claim 9, wherein the accessory body further includes a threaded bore and the muzzle accessory further includes a set screw within the threaded bore for maintaining the detent spring within the retention receptacle.

11. The accessorized firearm of claim 10, wherein the accessory body further includes an access channel and the detent spring extends proximally from the retention receptacle into the access channel.

12. The accessorized firearm of claim 11, wherein the through-bore intersects the through-channel and the access channel.

13. The accessorized firearm of claim 1, wherein the locking pin includes tapered ends.

14. The accessorized firearm of claim 1, wherein at least one side of the circumferential channel is tapered.

15. The accessorized firearm of claim 1, wherein the firearm further includes a slide having a slot and a barrel receipt hole, the barrel is positioned within the slide and extends distally through the barrel receipt hole of the slide, and the accessory body includes an alignment tab structured to engage the slot of the slide.

16. The accessorized firearm of claim 15, wherein the barrel includes an outer surface provided with a receptacle and the alignment tab includes a lower surface provided with an alignment groove, the accessorized firearm further comprising an alignment key within the receptacle of the barrel, the alignment key being received by the alignment groove of the alignment tab.

17. A muzzle accessory for installation on a barrel of a firearm, a distal end of the barrel including a main firing tube, a cylindrical barrel extension extending distally from the main firing tube, a distally-facing annular ledge and a transverse groove, the muzzle accessory comprising:

an accessory body having a through-channel sized to receive the barrel of the firearm and a lateral through-bore positioned to align with the groove of the barrel when the barrel is received within a barrel receptacle of the accessory body;

a locking member structured to engage the groove of the barrel to lock the muzzle accessory to the barrel, the locking member including a locking pin structured to engage the through-bore and the groove of the barrel, the locking pin including a circumferential channel, and a detent spring positioned to engage the circumferential channel when the locking pin is inserted into the through-bore.

18. The muzzle accessory of claim 17, wherein the through-channel of the accessory body includes the barrel receptacle sized to receive the main firing tube of the barrel and an intermediate channel distally of and in communication with the barrel receptacle, the intermediate channel sized to receive the barrel extension of the barrel.

19. The muzzle accessory of claim 18, wherein the through-channel further includes an exit channel distally of and in communication with the intermediate channel, the exit channel having a diameter sized to approximately match a diameter of a firing channel of the barrel.

20. The muzzle accessory of claim 18, wherein the accessory body further includes a proximally facing annular wall at a boundary between the barrel receptacle and the intermediate channel, the muzzle accessory further comprising an O-ring sized to be received within the barrel receptacle adjacent to the annular wall.

21. The muzzle accessory of claim 20, wherein the O-ring is constructed from a polymer capable of withstanding high temperatures.

22. The muzzle accessory of claim 19, wherein the accessory body further includes a retention receptacle sized to receive the detent spring.

23. The muzzle accessory of claim 22, wherein the accessory body further includes a threaded bore, the muzzle accessory further comprising a set screw within the threaded bore for maintaining the detent spring within the retention receptacle.

24. The muzzle accessory of claim 23, wherein the accessory body further includes an access channel and the detent spring extends proximally from the retention receptacle into the access channel.

25. The muzzle accessory of claim 24, wherein the through-bore intersects the through-channel and the access channel.

26. The muzzle accessory of claim 22, wherein the locking pin includes tapered ends and at least one side of the circumferential channel is tapered.

27. The muzzle accessory of claim 17, wherein the accessory body further includes an alignment tab structured to engage with a slot of a slide of the firearm.

28. The muzzle accessory of claim 27, wherein the alignment tab includes a lower surface provided with an alignment groove sized to receive an alignment key of the barrel.

29. The muzzle accessory of claim 17, wherein the accessory body includes a sight-receipt hole to receive a front sight.

30. The muzzle accessory of claim 29, wherein the accessory body includes an access window sized to receive a tool for affixing the front sight to the accessory body using a sight screw.

* * * * *